United States Patent [19]

Fitzgerald

[11] 4,120,727

[45] Oct. 17, 1978

[54] POLYMERIC CYANOALKYL ACRYLATE SILVER HALIDE PEPTIZER

[75] Inventor: Maurice J. Fitzgerald, Canton, Mass.

[73] Assignee: Polaroid Corporation, Cambridge, Mass.

[21] Appl. No.: 806,150

[22] Filed: Jun. 13, 1977

Related U.S. Application Data

[63] Continuation-in-part of Ser. No. 638,818, Dec. 8, 1975, abandoned, which is a continuation-in-part of Ser. No. 531,801, Dec. 11, 1974, abandoned, which is a continuation-in-part of Ser. No. 339,824, Mar. 9, 1973, abandoned.

[51] Int. Cl.[2] ..... G03C 1/72

[52] U.S. Cl. ..... 96/114

[58] Field of Search ..... 96/114

[56] References Cited

U.S. PATENT DOCUMENTS

| | | | |
|---|---|---|---|
| 2,772,166 | 11/1956 | Fowler | 96/114 |
| 2,808,331 | 10/1957 | Unruh et al. | 96/114 |
| 2,831,767 | 4/1958 | Dann et al. | 96/114 |
| 2,852,382 | 9/1958 | Illingsworth et al. | 96/114 |
| 3,488,708 | 1/1970 | Smith | 96/84 |
| 3,512,985 | 5/1970 | Harvey | 96/114 |
| 3,516,830 | 6/1970 | Whitely | 96/67 |
| 3,706,564 | 12/1972 | Hollister et al. | 96/114 |

*Primary Examiner*—Jack P. Brammer

*Attorney, Agent, or Firm*—Esther A. H. Hopkins

[57] ABSTRACT

A photosensitive silver halide emulsion wherein the silver halide peptizer comprises a cyanoalkyl acrylate polymer or copolymer.

7 Claims, No Drawings

POLYMERIC CYANOALKYL ACRYLATE SILVER HALIDE PEPTIZER

This application is a continuation-in-part of copending application Ser. No. 638,818 filed Dec. 8, 1975 now abandoned which was a continuation-in-part of application Ser. No. 531,801 filed Dec. 11, 1974 now abandoned, which was a continuation-in-part of application Ser. No. 339,824 filed Mar. 9, 1973 now abandoned.

BACKGROUND OF THE INVENTION

This invention relates to photography and more particularly, to novel photosensitive photographic elements, particularly novel photosensitive emulsions.

As a result of the known disadvantages of gelatin, in particular, its variable photographic properties and its fixed physical properties, for example, its diffusion characteristics; much effort has been expended in the past in order to replace gelatin with a suitable synthetic grain-growing protective colloid for photographic silver halide emulsions. Many synthetic polymeric materials have heretofore been suggested as peptizers for silver halide emulsions, however, these have generally not functioned satisfactorily and frequently have not fulfilled all of the basic requirements for a photosensitive silver halide emulsion grain-growing protective colloid listed following:

(1) absent (or constant) photographic activity;

(2) ability to form an adsorption layer on microcrystals of silver halide permitting stable suspensions to be obtained;

(3) ability to form adsorption layers as described in (2) above which do not prevent growth of silver halide microcrystals during physical ripening; and (4) solubility in water solution.

In addition, hithertofore, much emphasis has been placed on the ability of the synthetic polymeric material to mix with gelatin, as this property has been critical for employment in partial substitution reactions with gelatin. Consequently, many synthetic polymers of the prior art have been materials which allow for the growth of silver halide crystals only in the presence of gelatin.

Polymeric materials having cyanoacetate units, i.e., $-OCOCH_2CN$, are known to be useful in photographic compositions, as shown by Smith, U.S. Pat. No. 3,554,987; Smith British Pat. No. 1,215,610; Beavers, U.S. Pat. No. 3,576,628; and Unruh et al, U.S. Pat. No. 2,808,331. These polymers are clearly different from the polymers of the instant invention since the cyanoacetate appendage of the former is affixed to an alkylene chain through an O atom, whereas the cyanoalkyl acrylate appendage of the present polymers is affixed to the polymeric backbone through a C atom. Similarly, French Pat. No. 1,588,198 describes photographic elements comprising copolymers of vinyl alcohol and cyanoethyl vinyl ether, whose cyanoalkyl appendages are affixed to the polymeric backbone through the ether O atom. Polymers or copolymers of acrylonitrile have been described in the art as being useful additives to photographic silver halide emulsions, (e.g., see British Pat. No. 1,215,610 and Japanese Pat. No. 21448/71); however, it has been hithertofore unknown to employ the cyanoalkyl acrylate polymers and copolymers described herein as binders for said silver halide emulsions.

SUMMARY OF THE INVENTION

The present invention is directed to a photosensitive silver halide emulsion wherein the silver halide crystals have adsorbed on their surface at least a substantially continuous layer of a water soluble film-forming polymeric silver halide grain-growing protective colloid having in its structure at least about 0.5 mol percent repeating units of the formula:

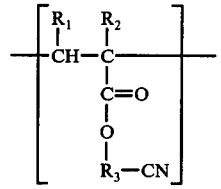

wherein $R_1$ is hydrogen, a lower alkyl group, i.e., 1–4 carbon alkyl group, preferably methyl or ethyl, or a halogen, i.e., chloro, bromo, or iodo; $R_2$ is hydrogen, a lower alkyl group, a halogen or cyano group; and $R_3$ is a 1–6 carbon alkylene group or a 3–6 carbon cycloalkylene group. The above-described polymers are herein designated for convenience as cyanoalkyl acrylate polymers.

DETAILED DESCRIPTION OF THE INVENTION

As indicated, the present invention is directed to photosensitive silver halide emulsions wherein photosensitive silver halide crystals have adsorbed on their surface a substantially continuous layer of a water soluble synthetic grain-growing protective colloid comprising a film-forming cyanoalkyl acrylate polymer having in its structure repeating units represented by the formula set forth above. The term "film-forming" is intended to designate a molecular weight sufficiently high to form a film, for example, a molecular weight comparable to that of gelatin (i.e., around 15,000). Adsorption of this layer of synthetic grain-growing protective colloid on the surface of the silver halide crystal as the crystal is formed occurs because the synthetic colloid is used as the sole emulsifying agent during the precipitation of the silver halide crystal. As the crystal is formed, a substantially continuous layer is directly adsorbed on the surface. When the desired degree of ripening has been reached, other "bodying" polymers which determine overall diffusion characteristics of the bulk emulsions may be added, but the crystal growth, the crystal habit and, indeed, the major properties of the silver halide grain are determined by the polymer directly adsorbed on the surface, in this invention, the cyanoalkyl acrylate polymer detailed above.

Such polymers have been found to effectively peptize silver halide emulsions in the absence of gelatin and to substantially meet all the basic requirements for a gelatin substitute, as delineated above. These polymers also show a resistance to the growth of microorganisms.

As examples of monomers represented by the formula:

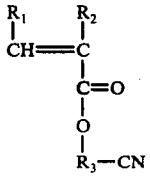

wherein $R_1$, $R_2$ and $R_3$ have the above-indicated definitions and which are contemplated as being suitable for providing the cyanoalkyl acrylate polymers, mention may be of the following:

1) $CH_2{=}CH{-}COO{-}CH_2{-}C{\equiv}N$
cyanomethyl acrylate

2) $CH_2{=}CH{-}COO{-}CH_2CH_2{-}C{\equiv}N$
β-cyanoethyl acrylate

3) $CH_2{=}C(CH_3){-}COO{-}CH_2CH_2{-}C{\equiv}N$
β-cyanoethyl methacrylate

4) $CH_3CH{=}C(Cl){-}COO{-}CH_2CH_2CH_2{-}C{\equiv}N$
γ-cyanopropyl-2-chloro-2-butenoate 5) $CH_3CH_2CH{=}C(Br){-}COO{-}CH_2CH_2CH_2CH_2{-}C{\equiv}N$
δ-cyanobutyl-2-bromo-2-pentenoate 6) $Cl{-}CH{=}C(CH_2CH_3){-}COO{-}CH_2CH_2CH_2CH_2CH_2{-}C{\equiv}N$
ε-cyanopentyl-2-ethyl-3-chloroacrylate 7) $Br{-}CH{=}C(C{\equiv}N){-}COO{-}(CH_2)_6{-}C{\equiv}N$
6'-cyano-n-hexyl-2-cyano-3-bromoacrylate 8) 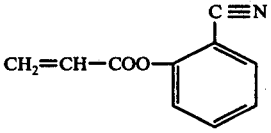
2-acryloyloxybenzonitrile 9) 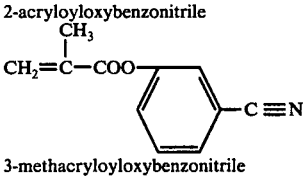
3-methacryloyloxybenzonitrile 10) 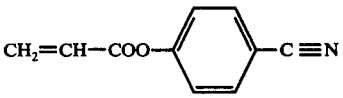
4-acryloyloxybenzonitrile 11) 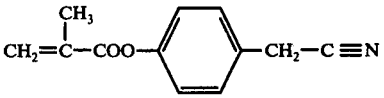
4-methacryloyloxybenzylcyanide 12) 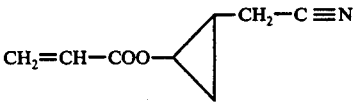
2-(cyanomethyl)cyclopropyl acrylate 13) 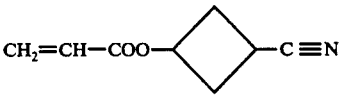
3-cyanocyclobutyl acrylate 14) 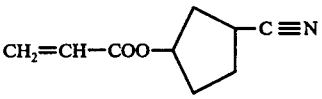

-continued 3-cyanocyclopentyl acrylate

15) 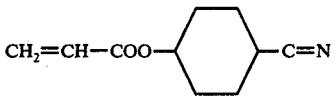
4-cyanocyclohexyl acrylate

The instant polymers are preferably interpolymers or copolymers having, in addition to the repeating units defined above, any compatible repeating unit or various repeating units which are not detrimental to photographic silver halide emulsions and which allow the resultant polymer to be soluble in water. Examples of typical comonomers which may be employed in forming the copolymers suitable for use in the present invention include the following ethylenically-unsaturated monomers:

16) $CH_2{=}CH{-}COOH$
acrylic acid

17) $CH_2{=}C(CH_3){-}COOH$
methacrylic acid

18) $CH_2{=}C(Cl){-}COOH$
α-chloroacrylic acid

19) $CH_2{=}C(Br){-}COOH$
α-bromoacrylic acid

20) $CH_3CH{=}CH{-}COOH$
crotonic acid

21) $CH_3CH{=}CH{-}COOH$
isocrotonic acid

22) $Cl{-}CH{=}CH{-}COOH$
β-chloroacrylic acid

23) $Br{-}CH{=}CH{-}COOH$
β-bromoacrylic acid

24) $Cl{-}CH{=}C(CH_3){-}COOH$
β-chloromethacrylic acid

25) $CH_2{=}CH{-}COO{-}CH_3$
methyl acrylate

26) $CH_2{=}C(CH_3){-}COO{-}CH_2CH_3$
ethyl methacrylate

27) $CH_2{=}C(Cl){-}COO{-}CH_2CH_2CH_3$
n-propyl-α-chloroacrylate

28) $Br{-}CH{=}CH{-}COO{-}CH(CH_3)_2$
isopropyl-β-bromoacrylate

29) $CH_2{=}C(CH_3){-}COO{-}CH_2CH(CH_3)_2$
isobutyl methacrylate

30) $CH_2{=}CH{-}COO{-}CH_2CH_2OH$
β-hydroxyethyl acrylate

31) $CH_2{=}CH{-}COO{-}CH_2CH_2CH_2OH$
γ-hydroxypropyl acrylate

32) $CH_2{=}C(CH_3){-}COO{-}CH_2CH(OH)CH_3$
2-hydroxy-n-propyl methacrylate

33) $CH_2{=}CH{-}CO{-}NH_2$
acrylamide

34) $CH_2{=}C(Cl){-}CO{-}NH_2$
α-chloroacrylamide

35) $CH_2{=}C(Br){-}CO{-}NH_2$
α-bromoacrylamide

36) $CH_2{=}C(CH_3){-}CO{-}NH_2$
methacrylamide

-continued

37) $CH_2=C(CH_2CH_3)-CO-NH_2$
α-ethylacrylamide

38) $Cl-CH=C(CH_3)-CO-NH_2$
β-chloromethacrylamide

39) $Br-CH=C(Br)-CO-NH_2$
2,3-dibromoacrylamide

40) $CH_3CH=CH-CO-NH_2$
crotonamide

41) $CH_2=C(CH_3)-CO-NH-CH_3$
N-methylmethacrylamide

42) $CH_2=CH-CO-N(CH_3)_2$
N,N-dimethylacrylamide

43) $CH_2=C(Cl)-CO-NH-CH_2CH_3$
N-ethyl-α-chloroacrylamide

44) $CH_2=CH-CO-NH-C(CH_3)_3$
N-tertiary butylacrylamide

45) 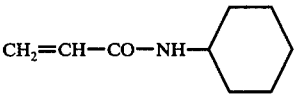
N-cyclohexylacrylamide

46) $CH_2=CH-CO-NH-C(CH_3)_2-CH_2-C(CH_3)_3$
N-tertiary octyl acrylamide

47) $CH_2=CH-CO-NH-CH_2OH$
N-methylolacrylamide

48) $CH_2=CH-CO-NH-CH_2CH_2OH$
N-(β-hydroxyethyl) acrylamide

49) $CH_2=CH-CO-NH-C(CH_3)_2-CH_2-C(=O)-CH_3$
diacetone acrylamide

50) $CH_2=CH-CO-NH-CH(CH_3)_2$
N-isopropylacrylamide

51) 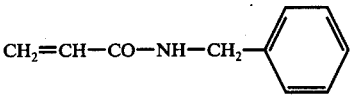
N-benzylacrylamide

52) $CH_2=CH-O-CH_3$
methylvinyl ether

53) $CH_2=C(Cl)-O-CH_2CH_3$
ethyl α-chlorovinyl ether

54) $CH_2=CH-O-CH_2CH_2Cl$
β-chloroethyl vinyl ether

55) $CH_2=CH-O-CH_2CH_2-OCH_3$
β-methoxyethyl vinyl ether

56) $CH_2=C(CH_3)-O-CH_2CH(CH_3)_2$
isobutyl isopropenyl ether

57) $CH_2=CH-O-CH_2CH_2CH_2CH_2CH_2-CH(CH_3)_2$
isooctyl vinyl ether

58) $CH_2=CH-C(=O)-CH_3$
methylvinyl ketone

59) $CH_2=C(CH_3)-C(=O)-CH_2CH_3$
ethyl isopropenyl ketone

60) $CH_2=C(Cl)-C(=O)-CH_2CH_2CH_3$
n-propyl-α-chlorovinyl ketone

61) $CH_2=C(Br)-C(=O)-CH_2CH_2-O-CH_3$
β-methoxyethyl-α-bromovinyl ketone

-continued

62) $CH_2=C(CH_2CH_3)-C(=O)-CH_2CH_2OH$
β-hydroxyethyl-1-butene-2-yl ketone

63) $CH_2=CH-CHO$
acrolein

64) $CH_3-CH=CH-CHO$
crotonaldehyde

65) $CH_2=C(Cl)-CHO$
α-chloroacrolein

66) $CH_2=C(Br)-CHO$
α-bromoacrolein

67) $CH_2=CH-C\equiv N$
acrylonitrile

68) $CH_3CH=CH-C\equiv N$
crotononitrile

69) $CH_2=C(Cl)-C\equiv N$
α-chloroacrylonitrile

70) $CH_2=C(Br)-C\equiv N$
α-bromoacrylonitrile

71) $BrCH=C(CH_3)-C\equiv N$
β-bromomethacrylonitrile

72) $ClCH=C(CH_2CH_3)-C\equiv N$
β-chloroethacrylonitrile

73) $CH_2=C(C\equiv N)-COO-CH_3$
methyl α-cyanoacrylate

74) $CH_2=CH-CO-NH-CH_2-CO-NH_2$
acrylamidoacetamide

75) $CH_2=C(CH_3)-CO-NH-CH_2-CO-NH_2$
methacrylamidoacetamide

76) $CH_3CH=CH-CO-NH-CH(CH_3)-CO-NH-CH_3$
2-crotonamido-N-methylpropionamide

77) $CH_2=CH-CO-NH-CH(CH_3)-CO-NH_2$
2-acrylamidopropionamide

78) $CH_2=C(CH_3)-CO-NH-CH(CH_3)-CO-NH_2$
2-methacrylamidopropionamide

79) $CH_2=C(Cl)-CO-NH-CH(CH(CH_3)_2)-CO-NH_2$
2-(α-chloroacrylamide)-3-methylbutyramide 80) $CH_2=CH-CO-NH-CH_2-NH-CO-CH_3$
N-(acetamidomethyl)acrylamide 81) $CH_2=C(CH_3)-CO-NH-CH_2-NH-CO-CH_2CH_3$
N-(propionamidomethyl)methacrylamide 82) $CH_2=C(Cl)-CO-NH-CH_2-NH-CO-CH_2CH_2CH_3$
N-(n-butyramidomethyl) α-chloroacrylamide 83) 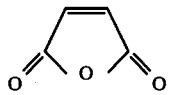
maleic anhydride 84) $HOOC-CH=CH-COOH$
maleic acid 85) $HOOC-CH=CH-CO-NH_2$
maleic acid amide 86) $HOOC-CH=CH-CO-NH-CH_2CH_3$
N-ethylmaleic acid amide -continued $CH_3-OOC-CH=CH-CO-NH-CH_3$
N-methyl methylmaleate amide
$CH_2=CH-OOCH$
vinylformate
$CH_2=CH-OOC-CH_3$
vinyl acetate
$CH_2=CH-OH$ (obtained by hydrolyzing copolymerized vinyl acetate)
vinyl alcohol
$CH_2=C(CH_3)-OOC-CH_2Br$
isopropenyl bromoacetate
$CH_2=CH-OOC-C(CH_3)_3$
vinyl pivalate
$CH_2=CH-NH-COO-C(CH_3)_3$
N-vinyl-tertiary butylcarbamate
$CH_2=C(COOH)-CH_2-COO-CH_2CH_3$
ethyl-3-carboxy-3-butenate

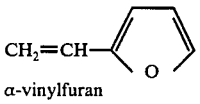
α-vinylfuran

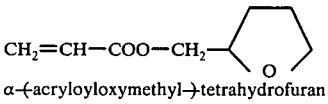
α-(acryloyloxymethyl)-tetrahydrofuran

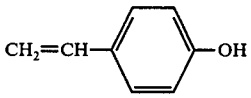
p-hydroxystyrene

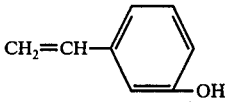
m-hydroxystyrene

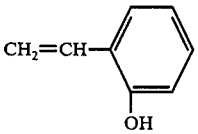
o-hydroxystyrene

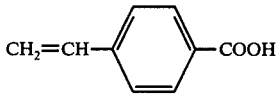
p-carboxystyrene

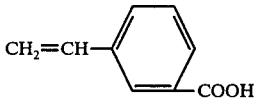
m-carboxystyrene

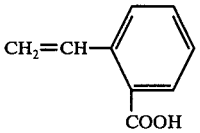
o-carboxystyrene

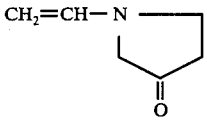
N-vinyl-2-pyrrolidone $CH_2=CH-CO-NH-CH_2CH_3$
N-ethylacrylamide $CH_2=CH-CO-NH-CH(COOH)-CH-(CH_3)_2$
N-acryloylvaline $CH_2=CH-CO-NH-CH(COOH)-CH_2-CH_2-S-CH_3$ -continued N-acryloylmethionine
$CH_2=CH-CO-NH-CH(CO-NH_2)-CH_2-CH_2-S-CH_3$
N-acryloylmethionamide
$CH_2=C(CH_3)-CO-NH-CH(COOH)-CH_2-CH_2-S-CH_3$
N-methacryloylmethionine Polymerization of the indicated monomers is achieved by conventional free radical polymerization techniques.

The following non-limiting examples illustrate the preparation of preferred copolymers within the scope of the present invention. The numerical ratio preceding the word "Copolymer" in the following examples refers to the molar ratio of monomers in the reaction mixture forming the copolymer.

EXAMPLE I

4:1 Copolymer of acrylamide/β-cyanoethyl acrylate 7.11 g of acrylamide, 3.13 g of β-cyanoethyl acrylate (commercially available from Monomer-Polymer, Borden Chemical Co., New York, New York, under the designation #7437) and 0.01 g of 2,2'-azobis-[2-methylpropionitrile] catalyst were dissolved in 80 ml of dimethylformamide. This solution was polymerized under $N_2$ in a sealed tube at 65° C. for 12 hours. A white viscous solution resulted which produced a precipitate in acetone. The precipitate was collected and dried under vacuum at 50° C. for 12 hours to yield a water-soluble white powder.

EXAMPLE II

4:1 Copolymer of acrylamide/β-cyanoethyl methacrylate

The procedure of Example I was followed with 3.48 g of β-cyanoethyl methacrylate (commercially available from Union Carbide Corp., New York, New York) instead of β-cyanoethyl acrylate.

The following general procedure may be used for preparing photographic emulsions using the above-described polymers of the instant invention as the sole peptizing agent for silver halide.

A water-soluble silver salt, such as silver nitrate may be reacted with at least one water-soluble halide, such as potassium, sodium or ammonium bromide preferably together with potassium, sodium or ammonium iodide, in an aqueous solution of the polymer. The emulsion of silver halide thus-formed contains water-soluble salts, as a by-product of the double decomposition reaction, in addition to any unreacted excess of the initial salts. To remove these soluble materials, the emulsion may be centrifuged and washed with distilled water to a low conductance. The emulsion may then be redispersed in distilled water. To an aliquot of this emulsion may be added a known quantity of a solution of bodying or thickening polymer, such as gelatin or a polyvinyl alcohol, preferably having an average molecular weight of about 100,000 (commercially available from E. I. du-Pont deNemours & Company, Wilmington, Delaware, designated Type 72-60). A surfactant, such as dioctyl ester of sodium sulfosuccinic acid, designated Aerosol OT, (commercially available from American Cyanamid Company, New York, New York), may be added and the emulsion coated onto a film base of cellulose triacetate sheet having a coating of hardened gelatin.

Alternatively, the soluble salts may be removed by adding to the emulsion a solution of polyacid, such as 1:1 ethylene:maleic acid copolymer, and lowering the pH to below 5, thereby bringing about precipitation of the polyacid carrying the silver halide grains along with the precipitate. The resulting precipitate may then be washed and resuspended by redissolving the polyacid at pH 6-7.

The emulsions may be chemically sensitized with sulfur compounds such as sodium thiosulfate or thiosulfate or thiourea, with reducing substances such as stannous chloride; with salts of noble metals such as gold, rhodium and platinum; with amines and polyamines; with quaternary ammonium compounds such as alkyl α-picolinium bromide; and with polyethylene glycols and derivatives thereof.

The emulsions of the present invention may also be optically sensitized with cyanine and merocyanine dyes. Where desired, suitable antifoggants, toners, restrainers, developers, accelerators, preservatives, coating aids, plasticizers, hardeners and/or stabilizers may be included in the composition of the emulsion.

The emulsions of this invention may be coated and processed according to conventional procedures of the art. They may be coated, for example, onto various types of rigid or flexible supports, such as glass, paper, metal, and polymeric films of both the synthetic type and those derived from naturally occurring products. As examples of specific materials which may serve as supports, mention may be made of paper, aluminum, polymethacrylic acid, methyl and ethyl esters, vinylchloride polymers, polyvinyl acetal, polyamides such as nylon, polyesters such as polymeric film derived from ethylene glycol-terephthalic acid, and cellulose derivatives such as cellulose acetate, triacetate, nitrate, propionate, butyrate, acetate propionate, and acetate butyrate. Suitable subcoats may be provided on the supports, for example a layer of gelatin, if necessary or desirable for adherence, as is well known in the art.

The polymers employed in the practice of the instant invention may contain from 0.5–100 mole % of the above indicated repeating units. The specific amount employed may be selected by the operator depending upon the grain particle size and habit desired.

By selecting appropriate comonomers, the instant copolymers may be made to be compatible with all water-soluble bodying polymers. Emulsions made from these novel polymers, may be bodied with any water-soluble polymers, overcoming the disadvantage encountered with gelatin which is only compatible with a very few polymers in a most limited pH range. As examples of specific materials which may serve as bodying polymers are gelatin, polyvinyl alcohol, polyacrylamide, polyalkylamides, polyvinyl pyrrolidone, polymethacrylamidoacetamide, vinyl alcohol/N-vinylpyrrolidone copolymers, poly-N-ethylaziridine, poly-N-(2-hydroxyethyl) aziridine, poly-N-(2-cyanoethyl) aziridine, poly(β-hydroxyethyl acrylate), polyethylene imine and cellulose derivatives such as hydroxyethyl cellulose, hydroxypropyl cellulose and methyl cellulose. It has been found that using only a small amount of one or more of the instant polymers, large amounts of photosensitive silver halide grains may be obtained.

An emulsion made from one of these polymers of the instant invention may therefore be bodied with a water-soluble polymer such that the polymeric constitution of the resulting emulsion comprises a relatively large percentage of the bodying polymer.

By selecting appropriate comonomers, copolymers with selected diffusion characteristics may be prepared. For example, the rate diffusion of alkali ion or a dye-developer through an emulsion comprising one of the polymers of this invention may be modified by varying the composition of the polymer.

The instant polymers containing acidic comonomers may be pH flocculated in order to remove the soluble salts formed as a byproduct of the double decomposition reaction between the water-soluble silver salt and the water-soluble halide, in addition to any unreacted excess of the initial salts. As an example, an acid copolymer may be precipitated by lowering the pH below 5 and then washed and resuspended by raising the pH to above 7.

The instant invention will be further illustrated by reference to the following nonlimiting examples:

EXAMPLE III

A solution of 4.15 g of a dry copolymer of 4:1 acrylamide/β-cyanoethyl acrylate as prepared in Example I above, in 266 ml of distilled water was adjusted to pH 3.0 with dilute nitric acid and maintained at a temperature of 55° C. To this solution, 88.0 g of dry potassium bromide and 1.0 g of dry potassium iodide were added.

A solution of 55 g. of silver nitrate in 500 ml of distilled water was prepared. From this silver nitrate solution, 100 ml was rapidy added with continuous agitation to the polymer-halide solution and the remainder was added over a period of 22 minutes. Thereafter, the emulsion was ripened for 60 minutes at 55° C. and then rapidly cooled to below 20° C.

EXAMPLE IV

An additional emulsion was also prepared according to the procedure of Example III, except that the 4:1 acrylamide/β-cyanoethyl methacrylate copolymer prepared in Example II was employed as the emulsion binder.

EXAMPLE V (control)

A solution of 4.15 g of the dry gelatin in 266 ml of distilled water was adjusted to pH 6.30 with dilute nitric acid and maintained at a temperature of 55° C. To this solution, 44.0 g of dry potassium bromide and 0.50 g of dry potassium iodide were added.

A solution of 55 g of silver nitrate in 500 ml of distilled water was prepared. From this silver nitrate solution, 100 ml was rapidly added to the gelatin-halide solution and the remainder was added over a period of 22 minutes. Thereafter, the emulsion was ripened for 30 minutes at 55° C., with continuous agitation, at the end of which it was rapidly cooled to below 20° C.

The following table summarized the silver halide grain sizes obtained in the emulsions prepared in the above examples, all of which contained octahedral platelet crystals:

TABLE 1

| Example | Polymer | Approximate grain size (microns) Range | Average |
|---|---|---|---|
| III | 4:1 acrylamide/β-cyanoethyl acrylate | 0.4–6.7 | 2.0 |
| IV | 4:1 acrylamide/β-cyanoethyl methacrylate | 0.4–1.8 | 0.9 |

TABLE 1-continued

| Example | Polymer | Approximate grain size (microns) Range | Average |
|---|---|---|---|
| V | gelatin | 0.2–1.8 | 1.0 |

In certain photographic applications, it may be desirable to replace part, but not all, of the gelatin in the photosensitive emulsion. In view of the characteristics of these polymers described above, and further, in view of their compatability with gelatin in substantially all proportions, it will be obvious that these polymers may also be suited for such use.

The term "photosensitive" and other terms of similar import are herein employed in the generic sense to describe materials possessing physical and chemical properties which enable them to form usable images when photoexposed by radiation actinic to silver halide.

Since certain changes may be made in the above products and processes without departing from the scope of the invention herein involved, it is intended that all matter contained in the above description shall be interpreted as illustrative only and not in a limiting sense.

What is claimed is:

1. A photosensitive silver halide emulsion wherein the silver halide grains have adsorbed on their surface a substantially continuous layer of an emulsion peptizer consisting essentially of a water soluble film-forming polymeric silver halide grain-growing protective colloid having in its structure at least about 0.5 mole percent repeating units of the formula:

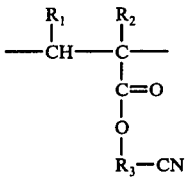

wherein $R_1$ is hydrogen, a lower alkyl group or a halogen; $R_2$ is hydrogen, a lower alkyl group, halogen or cyano group; and $R_3$ is a 1 to 6 carbon alkylene group or a 3 to 6 carbon cycloalkylene group.

2. The product as defined in claim 1 wherein said polymeric grain-growing protective colloid comprises a copolymer of a first monomer of the formula:

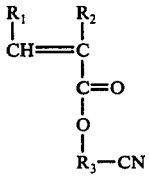

and a second ethylenically unsaturated monomer.

3. The product as defined in claim 2 wherein said first monomer is β-cyanoethyl acrylate.

4. The product as defined in claim 2 wherein said first monomer is β-cyanoethyl methacrylate.

5. The product as defined in claim 2 wherein said second monomer is acrylamide.

6. The product as defined in claim 1 which includes a bodying polymer.

7. The product as defined in claim 6 wherein said bodying polymer is polyvinyl alcohol.

* * * * *